US010309072B2

(12) United States Patent
Mei et al.

(10) Patent No.: US 10,309,072 B2
(45) Date of Patent: Jun. 4, 2019

(54) WATER-PERMEABLE PIPE PILE SYSTEM CAPABLE OF ACCELERATING SOIL CONSOLIDATION AND METHOD OF USING THE SAME

(71) Applicant: GUANGXI UNIVERSITY, Guangxi (CN)

(72) Inventors: Guoxiong Mei, Guangxi (CN); Meijuan Xu, Guangxi (CN); Wenbing Wu, Guangxi (CN); Yongyi Li, Guangxi (CN); Yanlin Zhao, Guangxi (CN); Zhen Zhang, Guangxi (CN)

(73) Assignee: GUANGXI UNIVERSITY, Guangxi (CN)

( * ) Notice: Subject to any disclaimer, the term of this patent is extended or adjusted under 35 U.S.C. 154(b) by 0 days.

(21) Appl. No.: 15/806,330

(22) Filed: Nov. 8, 2017

(65) Prior Publication Data

US 2018/0127938 A1 May 10, 2018

(30) Foreign Application Priority Data

Nov. 8, 2016 (CN) ..... 2016 1 0980639

(51) Int. Cl.
*E02D 3/10* (2006.01)
*E02D 7/02* (2006.01)
(Continued)

(52) U.S. Cl.
CPC ..... *E02D 5/226* (2013.01); *E02D 3/10* (2013.01); *E02D 5/32* (2013.01); *E02D 7/02* (2013.01); *E02D 2200/1685* (2013.01)

(58) Field of Classification Search
CPC . E02D 3/10; E02D 19/20; E02B 11/00; E02B 11/005
See application file for complete search history.

(56) References Cited

U.S. PATENT DOCUMENTS 3,646,770 A * 3/1972 Van Daalen ..... E02D 3/10 405/227
4,660,639 A * 4/1987 Visser ..... B09C 1/005 166/267
(Continued)

FOREIGN PATENT DOCUMENTS

CN 1664245 9/2005
FR 2564500 A1 * 11/1985 ..... E02B 3/10
(Continued)

*Primary Examiner* — Frederick L Lagman
(74) *Attorney, Agent, or Firm* — JCIPRNET

(57) ABSTRACT

Disclosed is a water-permeable pipe pile system capable of accelerating soil consolidation. The system includes a hollow pile, an aerating device, and a drain device. Holes are evenly distributed on the wall of the pile, the bottom of the pile is closed, and a gas-tight gland is provided on the top of the pile. The aerating device includes a gas pipe and a gas pump, the lower end of the gas pipe passing through the gas-tight gland and extending into the cavity of the pile, and the upper end thereof connected to the gas pump. The drain device includes a drain pipe and a water pump, the lower end of the drain pipe passing through the gas-tight gland and extending towards the bottom of the cavity of the pile, and the upper end thereof connected to the water pump. Combining advantages of a water-permeable pipe pile and features of the high-pressure gas splitting technology, the water-permeable pipe pile system can accelerate dissipation of excess pore water pressure in the surrounding soil mass and rapidly increase the skin friction of the pile. Requirements on the bearing capacity of pipe piles and the service life of a construction are thus satisfied and desirable economic effects are achieved. Besides, the method of using the system is simple.

4 Claims, 2 Drawing Sheets

(51) Int. Cl.
*E02D 5/22* (2006.01)
*E02D 5/32* (2006.01)

(56) References Cited

U.S. PATENT DOCUMENTS

| | | | | | |
|---|---|---|---|---|---|
| 4,883,589 | A * | 11/1989 | Konon | B01D 17/0202 | 210/140 |
| 5,111,883 | A * | 5/1992 | Savery | B09C 1/005 | 166/267 |
| 5,403,119 | A * | 4/1995 | Hoyle | B09C 1/005 | 405/128.2 |
| 5,927,907 | A * | 7/1999 | Shiraishi | E02D 3/00 | 166/401 |
| 6,183,162 | B1 * | 2/2001 | Sheppard | B09C 1/005 | 166/272.3 |
| 6,352,387 | B1 * | 3/2002 | Briggs | B09C 1/00 | 166/306 |
| 7,036,577 | B2 * | 5/2006 | Minamijima | E02D 3/10 | 166/236 |
| 2002/0162795 | A1 * | 11/2002 | Pollock | C02F 3/1268 | 210/621 |

FOREIGN PATENT DOCUMENTS

| | | | | |
|---|---|---|---|---|
| JP | 61001715 A * | 1/1986 | | E02D 3/10 |
| JP | 61211416 A * | 9/1986 | | E02D 3/10 |
| WO | WO-2014174525 A2 * | 10/2014 | | E02D 5/04 |
| WO | WO-2015029054 A1 * | 3/2015 | | E02D 3/10 |

* cited by examiner

WATER-PERMEABLE PIPE PILE SYSTEM CAPABLE OF ACCELERATING SOIL CONSOLIDATION AND METHOD OF USING THE SAME

CROSS-REFERENCE TO RELATED APPLICATION

This application claims the priority benefit of China application serial no. 201610980639.X, filed on Nov. 8, 2016. The entirety of the above-mentioned patent application is hereby incorporated by reference herein and made a part of this specification.

FIELD OF THE INVENTION

The present disclosure relates to the technical field of pile foundation engineering, and in particular, to a water-permeable pipe pile system capable of accelerating soil consolidation and a method of using the same, mainly applicable to soft soil foundation treatment.

BACKGROUND OF THE INVENTION

In recent years, with rapid social and economic development, significant development has been achieved in engineering and construction technologies. Thanks to features like simple application method in construction, great bearing capacity, high construction speed, etc., precast reinforced concrete pipe piles have been widely used in pile foundation engineering. A precast reinforced concrete pipe pile is a precast uniform-section concrete member which is an elongated hollow cylinder (for short, pipe pile). A pipe pile is manufactured by professional manufacturers following a process of firstly getting them shaped through pre-stressing process and centrifugation process and then cured by steam. In construction of a foundation at a building site, pipe piles are usually driven into the ground by means of hammering or static pressure, so as to form a base of a building. Yet, application of pipe piles in coastal areas is confronted with certain severe difficulties. In practice, during driving of pipe piles into the ground, pipe piles compress the surrounding soil mass, thus causing an increase of excess pore water pressure in the surrounding soil mass and further a decrease of strength of the surrounding soil mass. In coastal areas and areas with a high underground water level, the water content in the foundation soil mass is high. After pipe piles are driven into the ground, excess pore water in the surrounding soil mass is unable to rapidly dissipate, due to low permeability of the soil mass. Under the circumstances, the increase rate of skin friction mobilized at the soil-pile interface is small and in the meanwhile, problems such as rusting, aging, cracking, etc. of steel bars at pile-splicing places may appear, which affects the performance of bearing capacity of pipe piles and the service life thereof.

In the meanwhile, the high-pressure gas splitting technology has been preliminarily applied and popularized in soft soil foundation treatment. The high-pressure gas splitting technology works as below. High-pressure gas is delivered into deep foundation soil mass, so that the soil mass is split and cracks are formed. By way of this, porosity and permeability of the soil mass can be rapidly improved, which accelerates drainage of water and consolidation of the deep soil mass and thus shortens the consolidation time of the soil mass. Moreover, the high-pressure gas splitting technology, by applying a pressure to the deep soil mass using a high-pressure gas, radically changes the method of applying an additional stress for consolidation of foundation. Conventionally, a pressure is applied from the surface of the soil mass, in which case the additional stress reduces rapidly as the depth increases. The high-pressure gas splitting technology which applies pressure to the interior of the soil mass solves this problem, and thus helps to effectively consolidate the foundation soil mass. Yet, applying the high-pressure gas splitting technology alone in foundation treatment will increase construction procedures, further complicate the construction, possibly increase the construction costs, and result in unsatisfactory economic effects.

The above disclosed information is only used for helping to understand an overall background of the present disclosure. It should not be construed that the above information has been acknowledged or suggested in any form as a part of the prior art already-known by those skilled in the art.

SUMMARY OF THE INVENTION

An object of the present disclosure is to provide a water-permeable pipe pile system capable of accelerating soil consolidation, so as to solve the problem of small increase rate of skin friction after pile driving into the ground and the resulted problems such as rusting, aging, cracking, etc. of steel bars at pile-splicing places.

Another object of the present disclosure is to provide a method of using a water-permeable pipe pile system capable of accelerating soil consolidation in construction.

To achieve the above purposes, the present disclosure provides a water-permeable pipe pile system capable of accelerating soil consolidation which comprises a hollow pile, an aerating device, and a drain device. The wall of the pile is provided therein with evenly distributed holes, the bottom of the pile is closed, and the top of the pile is provided thereon with a gas-tight gland. The aerating device comprises a gas pipe and a gas pump. The lower end of the gas pipe passes through the gas-tight gland and extends into the cavity of the pile, and the upper end of the gas pipe is connected to the gas pump. The drain device comprises a drain pipe and a water pump. The lower end of the drain pipe passes through the gas-tight gland and extends towards the bottom of the cavity of the pile, and the upper end of the drain pipe is connected to the water pump.

Preferably, the bottom of the pile is provided thereon with a pile toe.

Preferably, the lower end of the drain pipe is provided thereon with a filter tube which is located inside the cavity.

Preferably, the lower end of the gas pipe is located above the upper part of the cavity.

A method of using the water-permeable pipe pile system capable of accelerating soil consolidation is provided. The method comprises steps of: (1) leveling a site and driving a water-permeable pipe pile into the ground; (2) installing an aerating device and a drain device, and installing a gas-tight gland, a gas pipe passing through the gas-tight gland and extending into the cavity of the pile, and a drain pipe passing through the gas-tight gland and extending towards the bottom of the cavity of the pile; and (3) repeatedly pressurizing the water-permeable pipe pile by means of the aerating device and repeatedly pumping water from the water-permeable pipe pile by means of the drain device, so as to accelerate dissipation of excess pore water pressure in the surrounding soil mass.

Compared with the prior art, the present disclosure achieves the following beneficial effects.

(1) Combining advantages of a water-permeable pipe pile and features of the high-pressure gas splitting technology, the water-permeable pipe pile system capable of accelerating soil consolidation, can accelerate dissipation of excess pore water pressure in the surrounding soil mass and rapidly increase the skin friction of the pile. Requirements on the bearing capacity of pipe piles and the service life of a construction can thus be satisfied and desirable economic effects can be achieved. Besides, the method of using the system is simple.

(2) With a strong water-permeable ability, the water-permeable pipe pile in the present disclosure further increases drainage paths for pore water in the surrounding soil mass, accelerates drainage of excess pore water, and rapidly increase the skin friction of the pile, which ensures the bearing capacity of the pile and satisfies the requirement on the construction service life.

(3) In the present disclosure, aerating is performed directly through the holes of the water-permeable pipe pile (the same with the holes for water drainage), and no additional aerating channels are required, which reduces construction work and renders the water-permeable pipe pile system using the gas splitting method to accelerate soil consolidation simpler and more effective. By way of this, the overall construction costs are saved, and the construction time is shortened. The system is cost effective and feasible.

DETAILED DESCRIPTION OF THE EMBODIMENTS

Embodiments of the present disclosure will be illustrated in detail hereinafter in combination with the accompanying drawings. Yet, it shall be understood that the protection scope of the present disclosure is not limited by the embodiments.

Unless specifically pointed out, in the description and the claims, the word "comprise" or its grammatical variants shall be understood as comprising the members or components later pointed out and not excluding other members or components.

Figure 1:
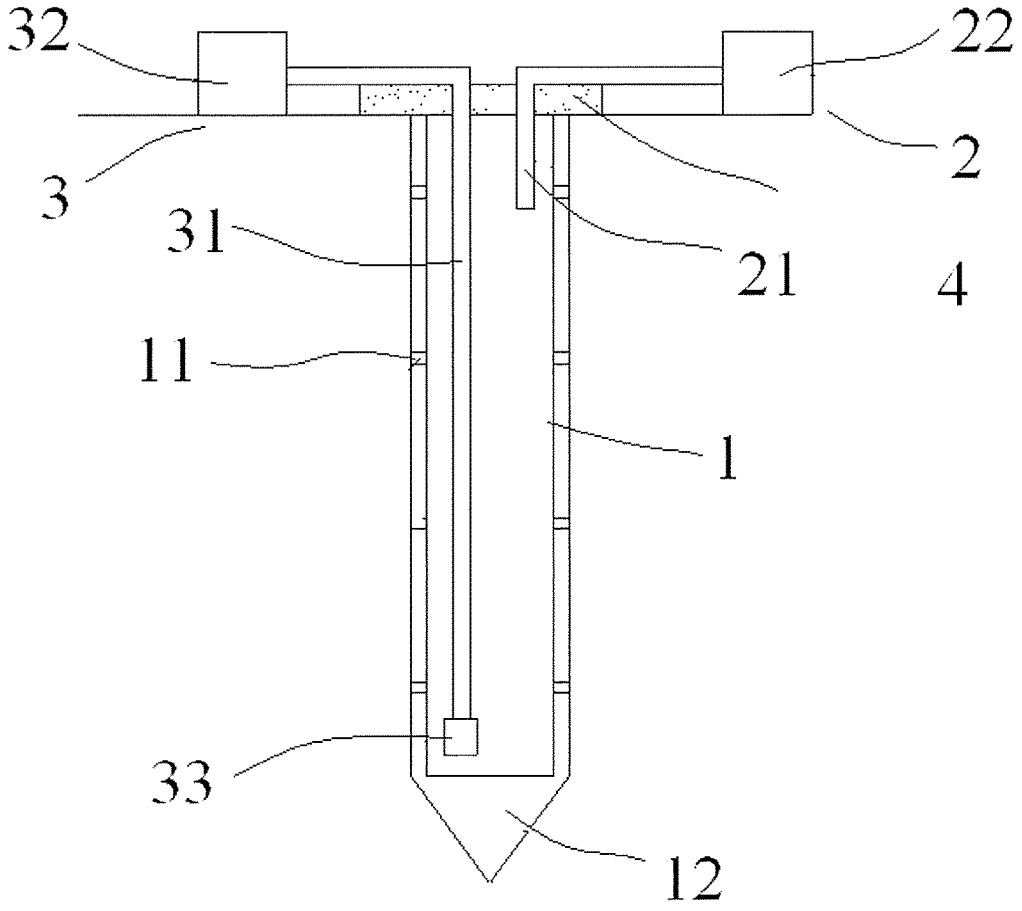
FIG. 1 schematically shows the structure of a water-permeable pipe pile system capable of accelerating soil consolidation in the present disclosure.
Figure 2:
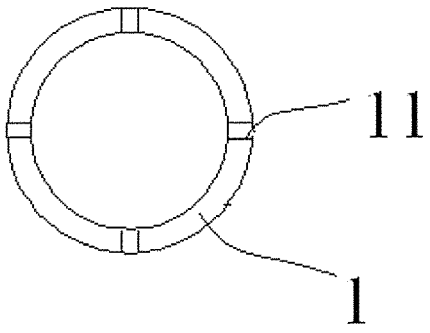
FIG. 2 schematically shows the top view of a pile in the water-permeable pipe pile system capable of accelerating soil consolidation in the present disclosure.
Figure 3:
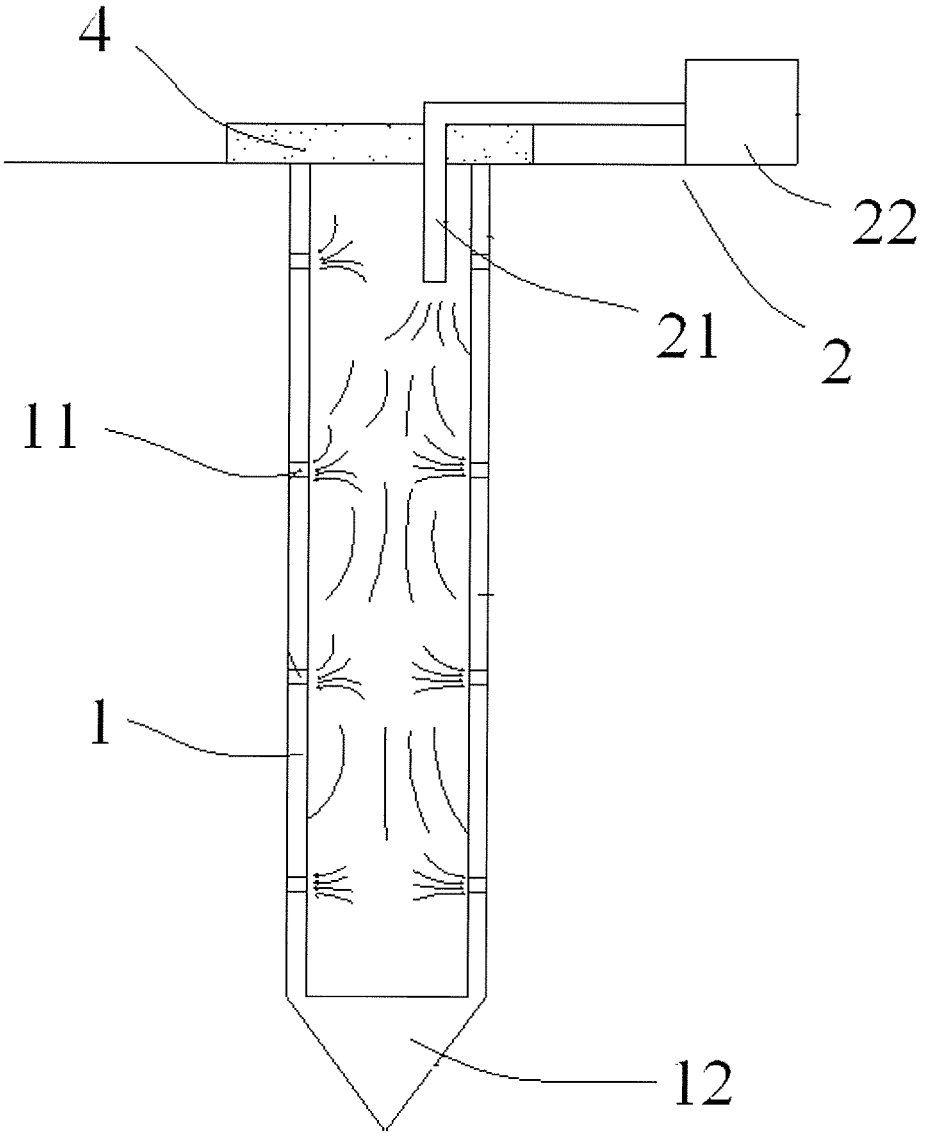
FIG. 3 schematically shows the mechanism of aerating by an aerating device in the water-permeable pipe pile system capable of accelerating soil consolidation in the present disclosure.

As shown in FIG. 1 to FIG. 3, a water-permeable pipe pile system capable of accelerating soil consolidation in the present disclosure comprises a pile 1, an aerating device 2, and a drain device 3. The pile 1 is hollow, that is, the pile 1 has a cavity. Holes 11 are evenly distributed on the wall of the pile 1. The pile 1 has a closed bottom. Preferably, a pile toe 12 is provided on the bottom of the pile. Having a pile toe is conducive to piling. A temporary gas-tight gland 4 is provided on the top of the pile 1. The aerating device 2 comprises a gas pipe 21 and a gas pump 22. The lower end of the gas pipe 21 passes through the gas-tight gland 4 and extends into the cavity of the pile 1. The lower end is located above the upper part of the cavity. The upper end of the gas pipe 21 is connected to the gas pump 22. The drain device 3 comprises a drain pipe 31 and a water pump 32. The lower end of the drain pipe 31 passes through the gas-tight gland 4 and extends towards the bottom of the cavity of the pile 1, and the upper end thereof is connected to the water pump 32. Combining advantages of a water-permeable pipe pile and features of the high-pressure gas splitting technology, the water-permeable pipe pile system capable of accelerating soil consolidation can accelerate dissipation of excess pore water pressure in the surrounding soil mass and rapidly increase the skin friction of the pile, which increases the bearing capacity of pipe piles and meets the requirement on the construction service life.

Preferably, a filter tube 33 is provided on the lower end of the drain pipe 31. The filter tube 33 is located inside the cavity. During pumping, the filter tube can filtrate large impurities, preventing entry of impurities into the filter tube and blocking therein.

A method of using the water-permeable pipe pile system capable of accelerating soil consolidation is provided. The method comprises steps of: (1) leveling a site and driving a water-permeable pipe pile into the ground; (2) installing an aerating device 2 and a pumping device 3, and then installing a gas-tight gland, a gas pipe passing through the gas-tight gland and extending into the cavity of the pile, and a drain pipe passing through the gas-tight gland and extending towards the bottom of the cavity of the pile; and (3) repeatedly pressurizing the water-permeable pipe pile by means of the aerating device and pumping water from the water-permeable pipe pile by means of the drain device, so as to accelerate dissipation of excess pore water pressure in the surrounding soil mass. The method ensures the service life of the pipe pile and application of this system in the technical field of pile foundation engineering can achieve obvious social and economic benefits.

The above exemplary embodiments are used for illustration rather than restricting the present disclosure and apparently various amendments can be made to the above embodiments based on teachings of the above disclosure. The purpose of selection and description of the above exemplary embodiments is to explain specific principles and practical application of the present disclosure, so that those skilled in the art can implement and take advantage of different exemplary embodiments of the present disclosure and make different choices and variations. The protection scope of the present disclosure is defined by the claims and equivalent forms of the claims.

The invention claimed is:

1. A water-permeable pipe pile system capable of accelerating soil consolidation, comprising:

a pile which is hollow, wherein a wall of the pile is provided therein with evenly distributed holes, a bottom of the pile is closed, and a top of the pile is provided thereon with a gas-tight gland, wherein the bottom of the pile is provided thereunder with a pile toe having a cone shape;

an aerating device, which comprises a gas pipe and a gas pump, wherein a lower end of the gas pipe passes through the gas-tight gland and extends into a cavity of the pile, and an upper end of the gas pipe is connected to the gas pump, wherein the lower end of the gas pipe is located below a part of the holes; and a drain device, which comprises a drain pipe and a water pump, wherein a lower end of the drain pipe passes through the gas-tight gland and extends towards a bottom of the cavity of the pile, and an upper end of the drain pipe is connected to the water pump.

2. The water-permeable pipe pile system capable of accelerating soil consolidation according to claim 1, wherein the lower end of the drain pipe is provided thereon with a filter tube which is located inside the cavity.

3. The water-permeable pipe pile system capable of accelerating soil consolidation according to claim 1, wherein the lower end of the gas pipe is located within an upper part of the cavity.

4. A method of using the water-permeable pipe pile system capable of accelerating soil consolidation according to claim 1, comprising the following steps:

(1) leveling a site and driving a water-permeable pipe pile into a ground, wherein a wall of the pile is provided therein with evenly distributed holes, and a bottom of the pile is provided thereunder with a pile toe having a cone shape;

(2) installing an aerating device and a drain device, and installing a gas-tight gland, wherein a gas pipe passes through the gas-tight gland and extends into a cavity of the pile, and a drain pipe passes through the gas-tight gland and extends towards a bottom of the cavity of the pile, wherein a lower end of the gas pipe is located below a part of the holes; and (3) repeatedly pressurizing the water-permeable pipe pile by means of the aerating device and repeatedly pumping water from the water-permeable pipe pile by means of the drain device, so as to accelerate dissipation of excess pore water pressure in a surrounding soil mass.

* * * * *